US009675507B1

(12) United States Patent
Wilson-Hunter

(10) Patent No.: US 9,675,507 B1
(45) Date of Patent: Jun. 13, 2017

(54) WHEELCHAIR ACCESSORY

(71) Applicant: Michaele Wilson-Hunter, East Hartford, CT (US)

(72) Inventor: Michaele Wilson-Hunter, East Hartford, CT (US)

( * ) Notice: Subject to any disclaimer, the term of this patent is extended or adjusted under 35 U.S.C. 154(b) by 0 days.

(21) Appl. No.: 15/226,698

(22) Filed: Aug. 2, 2016

Related U.S. Application Data

(60) Provisional application No. 62/291,054, filed on Feb. 4, 2016.

(51) Int. Cl.

| | |
|---|---|
| ***A61G 5/10*** | (2006.01) |
| ***A47C 7/66*** | (2006.01) |
| ***G09F 17/00*** | (2006.01) |
| *F21V 21/22* | (2006.01) |

(52) U.S. Cl.
CPC ..... *A61G 5/10* (2013.01); *G09F 17/00* (2013.01); *F21V 21/22* (2013.01)

(58) Field of Classification Search
CPC ..... A61G 5/10; B62J 17/08; A47C 7/66
USPC ..... 135/88.01, 88.02, 88.03
See application file for complete search history.

(56) References Cited

U.S. PATENT DOCUMENTS

| | | | | |
|---|---|---|---|---|
| 4,643,479 | A * | 2/1987 | Servi | A61G 5/10 297/184.15 |
| 5,318,055 | A * | 6/1994 | Olaniyan | A45B 11/02 135/16 |
| 5,791,761 | A * | 8/1998 | Bryant | A61G 5/10 297/217.6 |
| 6,254,116 | B1 * | 7/2001 | Szumlic | A61G 5/10 224/407 |
| 6,702,314 | B1 * | 3/2004 | Crose | A61G 5/10 280/304.1 |
| 7,651,242 | B1 * | 1/2010 | Guerrant | A61G 5/10 362/131 |
| 8,134,463 | B2 * | 3/2012 | Black | A61G 5/10 340/425.5 |
| 8,387,641 | B1 * | 3/2013 | Ilan | A61G 5/10 135/34.2 |
| 8,393,750 | B2 * | 3/2013 | Clement | F21V 21/22 116/202 |
| 8,448,728 | B2 * | 5/2013 | Schneider | A61G 5/10 180/2.2 |
| 2007/0035956 | A1 * | 2/2007 | Topps | B60Q 7/00 362/473 |
| 2007/0283875 | A1 * | 12/2007 | Durkin | G09F 17/00 116/173 |

(Continued)

FOREIGN PATENT DOCUMENTS

JP 2002-177335 * 6/2002

*Primary Examiner* — Robert Canfield
(74) *Attorney, Agent, or Firm* — RG Patent Consulting, LLC; Rachel Gilboy

(57) ABSTRACT

An apparatus for use with a wheelchair and more particularly to a collapsible wheelchair accessory as used to improve the visibility and comfort of an occupant of a wheelchair. Generally speaking, the wheelchair accessory includes a collapsible canopy, which can be opened and extended over the top of a wheelchair to protect the rider from rain and snow. Attached to one side of the canopy is a telescoping neon-lighted pole that projects at least six feet above the canopy, which will make the presence of the wheelchair visible to motorists from a great distance away.

4 Claims, 4 Drawing Sheets

(56) References Cited

U.S. PATENT DOCUMENTS

| | | | | |
|---|---|---|---|---|
| 2010/0141438 | A1* | 6/2010 | Black | A61G 5/10 340/540 |
| 2010/0253041 | A1* | 10/2010 | Schneider | A61G 5/1094 280/304.1 |
| 2011/0051214 | A1* | 3/2011 | Clement | F21V 21/22 359/235 |
| 2014/0313761 | A1* | 10/2014 | Nelson-Herron | G09F 17/00 362/523 |

* cited by examiner

WHEELCHAIR ACCESSORY

CROSS-REFERENCE TO RELATED APPLICATION

The present application is related to and claims priority from prior provisional application Ser. No. 62/291,054, filed Feb. 4, 2016 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention. It is not an admission that any of the information provided herein is prior art, or material, to the presently described or claimed inventions, or that any publication or document that is specifically or implicitly referenced is prior art.

1. Field of the Invention

The present invention relates generally to the field of accessories for use with wheelchairs and more specifically relates to a retractable canopy for a wheelchair that can be opened up to keep the rider dry when it is raining or snowing and a retractable neon-lighted telescoping flag pole to make the wheelchair more visible to motorists.

2. Description of the Related Art

Wheelchairs provide a convenient way for those who are unable to walk to get around independently. When someone in a wheelchair is on the sidewalk, crossing the street, or rolling along the side of the street, they are an unexpected hazard for drivers. Careful drivers are watching for pedestrians, bicyclists and other vehicles, and may not notice a person in a wheelchair. Wheelchairs do not usually have lights, making them hard to see at night or when it is raining or snowing. Also, wheelchairs do not usually have overhead coverings to protect the occupants from getting wet when it is raining or snowing.

Various attempts have been made to solve the above-mentioned problems such as those found in U.S. Pat. and Pub. Nos. U.S. Pat. No. 6,254,116B1 to Szumlic et al.; US20140313761 to Nelson-Herron et al; and U.S. Pat. No. 4,643,479 to Servi. This art is representative of accessories for wheelchairs. None of the above inventions, publications and patents, taken either singly or in combination, is seen to describe the invention as claimed.

Ideally, a wheel chair accessory should provide added safety and convenience for a person using a wheelchair and, yet would operate reliably and be manufactured at a modest expense. Thus, a need exists for a reliable wheelchair accessory to cover the occupant of a wheelchair during inclement weather and at the same time make the wheelchair more visible to motorists to avoid the above-mentioned problems.

BRIEF SUMMARY OF THE INVENTION

In view of the foregoing disadvantages inherent in the known wheelchair accessory art, the present invention provides a novel wheelchair accessory which will provide an overhead canopy covering for the occupant of a wheelchair for the purpose of providing protection from inclement weather and also provide a neon-lighted pole with a flag to make the wheelchair more visible to motorists. Another object of the present invention is to provide a wheelchair accessory in which the overhead canopy and the neon-lighted pole with a flag are collapsible into boxlike compartments which are part of the accessory upon the wheelchair.

The present invention holds significant improvements over known wheelchair accessories and serves as a new and improved accessory for wheelchairs. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate an embodiment of use for the present invention, wheelchair accessory, and is constructed and operative according to the teachings of the present invention.

The various embodiments of the present invention will hereinafter be described in conjunction with the appended drawings, wherein like designations denote like elements.

DETAILED DESCRIPTION

As discussed above, the embodiment of the present invention relates to a wheelchair accessory and more particularly to a collapsible and detachable wheelchair accessory as used to improve the visibility, comfort and safety of an occupant of a wheelchair. Generally speaking, the wheelchair accessory includes a canopy, which can be opened over the top of a wheelchair to protect the rider from rain and snow. Attached rearward and to one side of the canopy is a telescoping neon-lighted pole that projects six feet above the canopy when fully extended, and which will make the presence of the wheelchair visible from a great distance away. This accessory attaches to the back of the wheelchair frame where it will not interfere with a person using the handles to push the chair. The canopy extends horizontally from the back of the chair forwardly, extending far enough to protect the rider's feet from getting wet. The pole and canopy operate independently and are activated by pushing the appropriate buttons on either of two separate control pads. The pole can be retracted when going into a building or a vehicle so it will not be in the way. When the weather is clear and the canopy will not be needed, it can be removed from its position behind the rider's head and tucked into a storage compartment.

Figure 1:
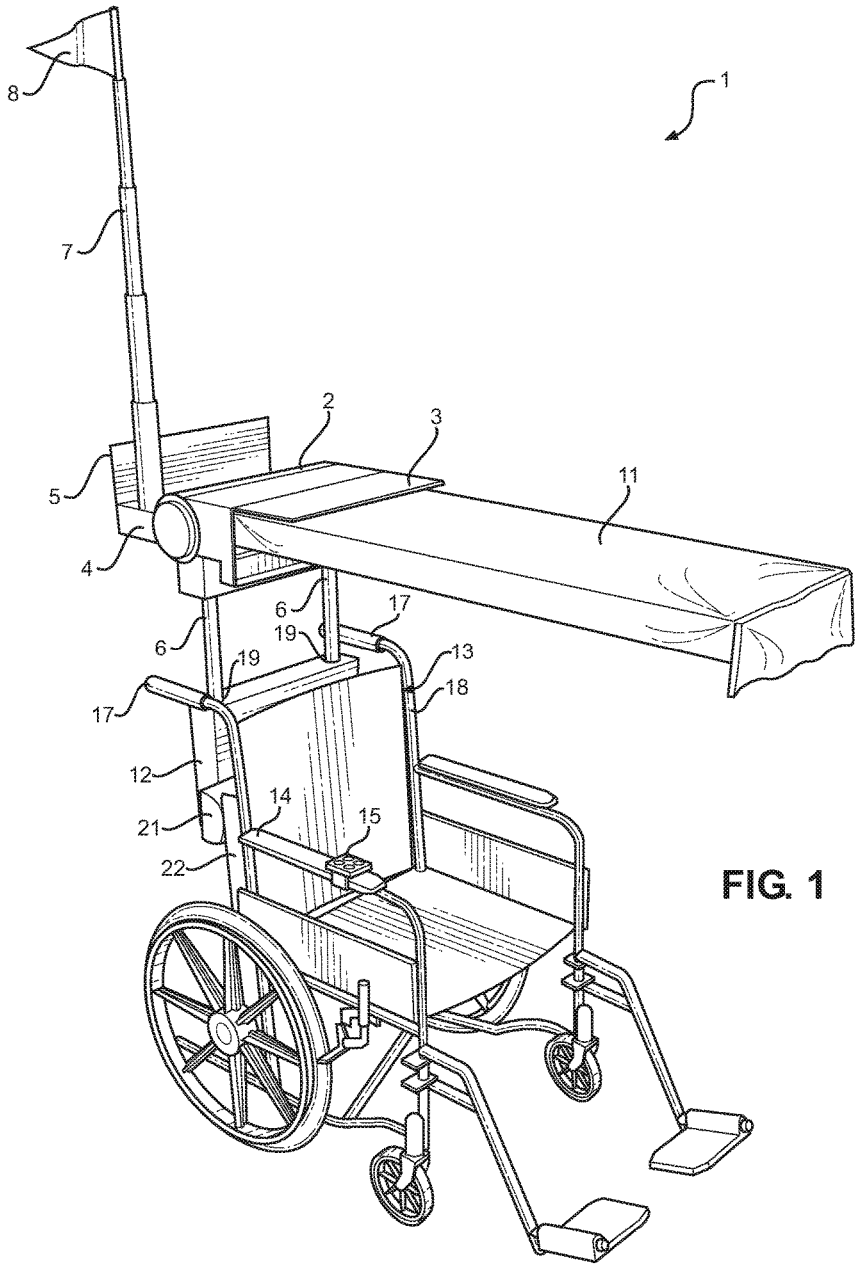
FIG. 1 is a perspective view illustrating a wheelchair accessory with the canopy fully extended and the neon-lighted telescoping flag pole fully extended according to an embodiment of the present invention.

Referring to the drawings by numerals of reference there is shown in FIG. 1, a wheelchair accessory 1 having a retractable canopy 11 for the purpose of providing shelter from inclement weather for a passenger of a wheelchair 13. The wheelchair accessory 1 attaches to the back frame 22 of the wheelchair 13 where it will not interfere with a person using the handles 17 to push the wheelchair 13. A first storage compartment 2 houses the retractable canopy 11 when not in use. Attached rearwardly and laterally of the first storage compartment 2 is a second storage compartment 4. For the purposes of this invention, a compartment is defined as a box like structure having an interior and four opposing sides. Housed within the second storage compartment 2 is a telescoping neon-lighted flag pole 7 with a flag 8. The telescoping neon-lighted flag pole 7 with the flag 8 are provided for the purpose of providing visibility of the wheelchair 13 to oncoming motorists. The telescoping neon-lighted flag pole 7 projects six feet above the retractable canopy 11 when fully extended, and which will make the presence of the wheelchair 13 visible from a great distance away. A light, not shown, is housed within the neon-lighted flag pole 7. The neon-lighted flag pole 7 can be retracted when going into a building or a vehicle so it will not be in the way. A motor, not shown, is also housed within the second storage compartment 2, and operates the telescoping neon-lighted flag pole 7 via a spring wire attached to the motor which extends and retracts the telescoping neon-lighted flag pole 7. An electrical conductor electrically connects the light and the power source.

Figure 4:
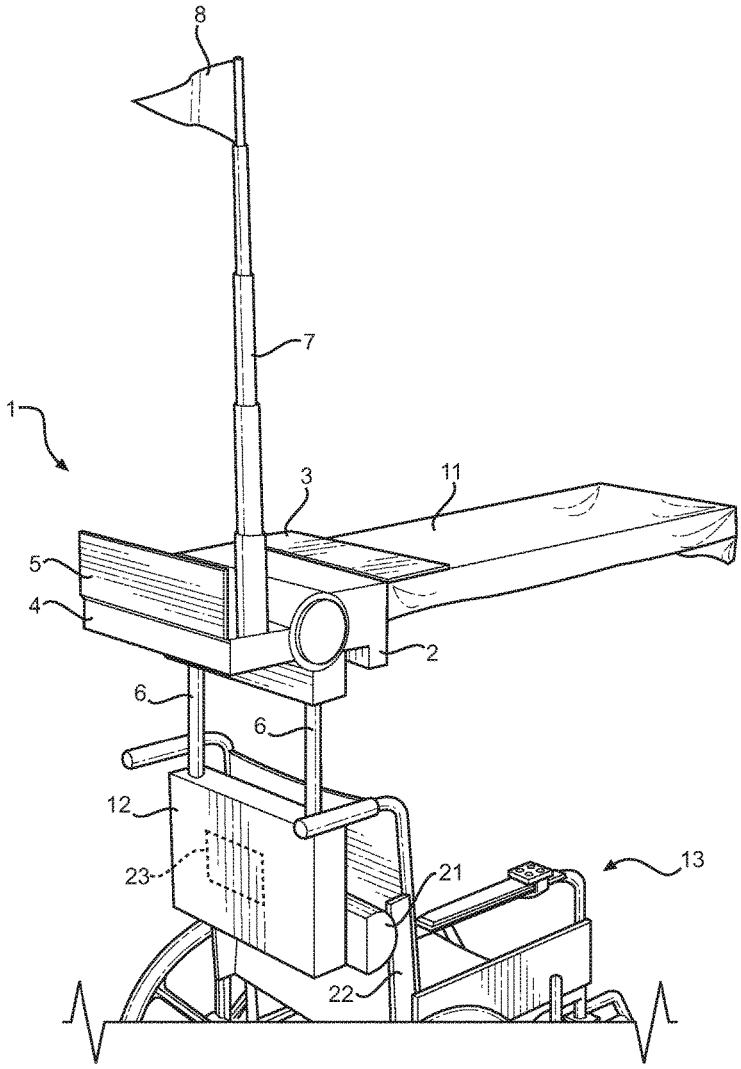
FIG. 4 is a rear view of the wheelchair accessory in its fully extended state according to an embodiment of the present invention.

A first control pad 15 is shown attached to wheelchair arm rest 14 and is configured to actuate the retractable canopy 11 and the telescoping neon-lighted flag pole 7 from an extended position to the retracted position. The first control pad 15 is intended to be easily accessed by the passenger of the wheelchair 13. The neon-lighted flag pole 7 and the canopy 11 can be operated independently and are activated by pushing the appropriate buttons on the first control pad 15. In addition, a second control pad 16, substantially identical to the first control pad 15, is provided and sits on one side of a third compartment 12 near to the handles 17 of the wheelchair 13 and is configured to raise or lower the retractable canopy 11 and the telescoping neon-lighted flag pole 7. The second control pad 16 is intended to be easily accessed by a person pushing the wheelchair 13. Both the first control pad 15 and the second control pad 16 are configured to operate the retractable canopy 11 and the telescoping neon-lighted flag pole 7 independently. A suitable power source 23 as shown schematically in FIG. 4 is provided and is housed within the third compartment 12 for powering the retractable canopy 11 and telescoping neon-lighted flag pole 7 so as to be selectively extended and retracted in response to activation of either the first control pad 15 or the second control pad 16. Ideally, the power source 23 would be a rechargeable battery which is housed within the third compartment 12 and which can be plugged into a wall outlet for recharging.

Figure 2:
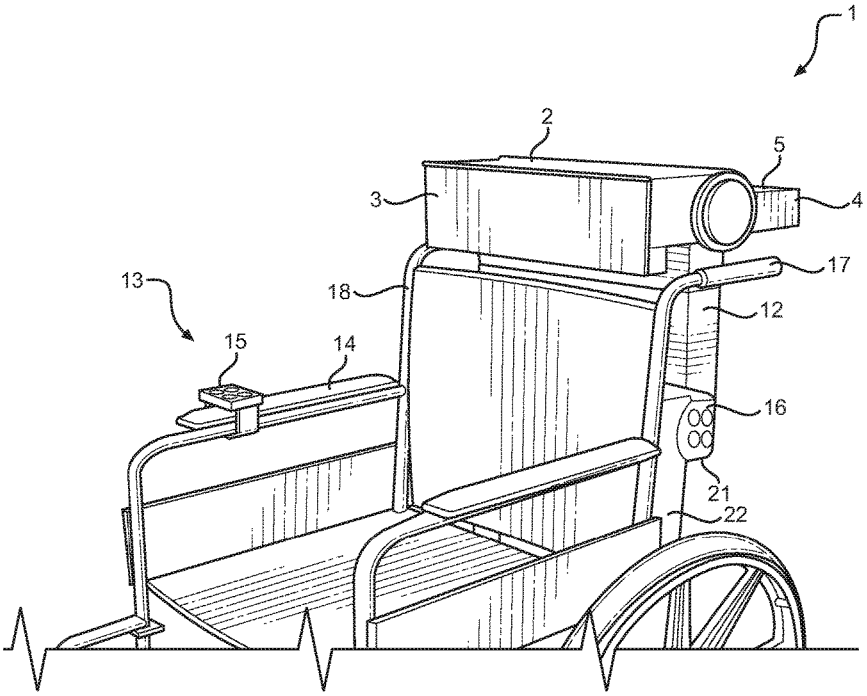
FIG. 2 shows a perspective view illustrating a wheelchair accessory in its fully collapsed state according to an embodiment of the present invention.

Referring now to FIG. 2 the wheelchair accessory 1 is shown in a collapsed condition. The first storage compartment 2 is shown having a first flap 3. The first flap 3 covers and encloses the retractable canopy 11 when the retractable canopy 11 is collapsed and stored within the first storage compartment 2. The second storage compartment 4 sits laterally behind and is secured to the first storage compartment 2 and houses the telescoping neon-lighted flag pole 7. The second storage compartment 4 has a second flap 5 which covers the second storage compartment 4 when the telescoping neon-lighted flag pole 7 is in a collapsed condition. The third compartment 12 is secured behind the wheelchair back rest 18 and between the wheelchair handles 17 by a unit attachment 21. The unit attachment 21 may consist of any suitable means such as a clamping bracket which would essentially clamp the wheelchair 13 in a mechanical stable vice like grip, or the like, which is configured to attach to the back frame 22 of the wheelchair 13.

A pair of lift arms 6 are provided and are housed within the third storage compartment 12. The third storage compartment also has a motor, not shown, which operates the lift arms 6. The lift arms 6 are operated hydraulically. The third storage compartment 12 has a pair of apertures 19 at an upper surface through which the pair of lift arms 6 are configured to selectively extend outwardly in response to the activation of either the first control pad 15 or the second control pad 16. The pair of lift arms 6 have upper ends secured to a bottom of the first storage compartment 2 such that the first storage compartment 2 and the second storage compartment 4 move in tandem with the lift arms 6. In the collapsed state, the lift arms 6 are housed in the third storage compartment 12 with the first and second storage compartments 2, 4 adjacent to an upper surface of the third storage compartment 12 and out of the way. In the extended state, the lift arms 6 extend out of the apertures 19 of the third storage compartment 12 and are configured to lift the first storage compartment 2 and the second storage compartment 4 up above the rider's head. The canopy 11 extends horizontally from the back of the wheelchair 13 forwardly, extending far enough to protect the rider's feet from getting wet.

Figure 3:
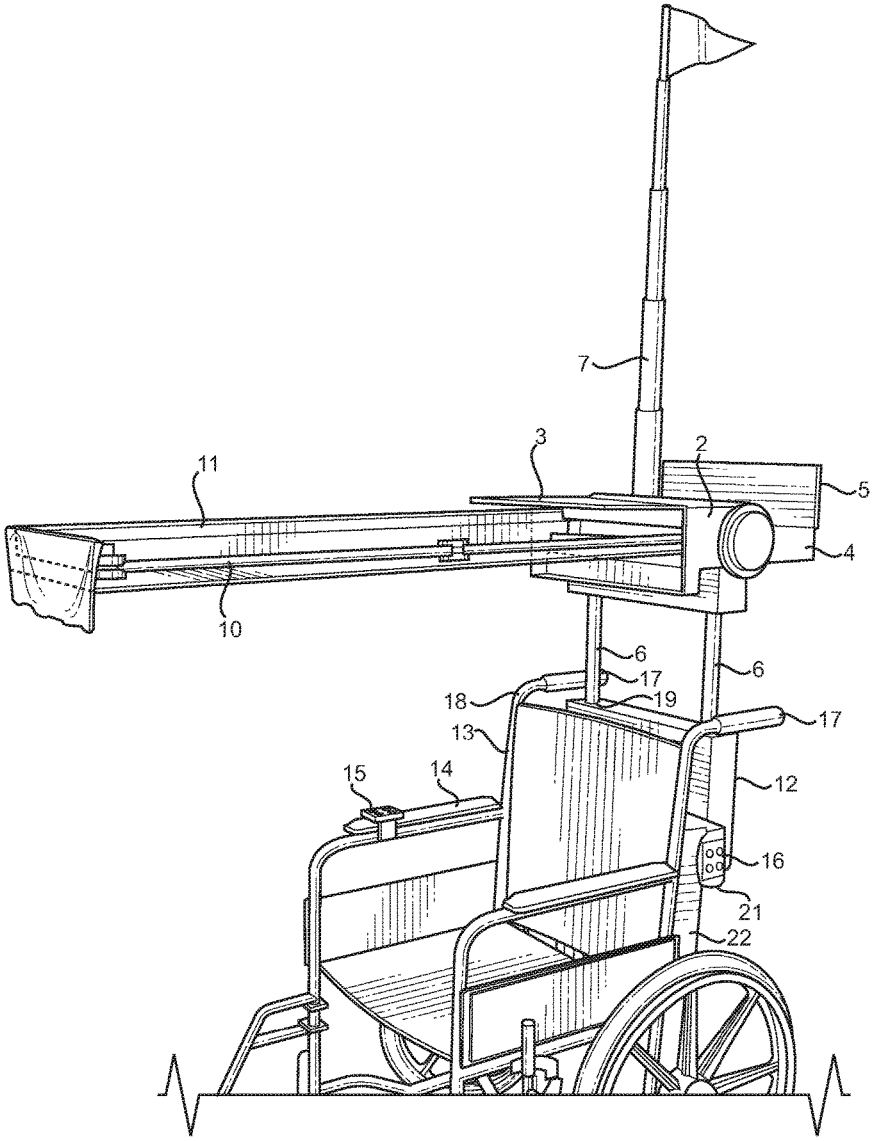
FIG. 3 is a perspective view of the wheelchair accessory illustrating the retractable frame underneath the canopy in the extended position according to an embodiment of the present invention.

FIG. 3 shows the retractable canopy 11 as having a retractable frame 10 having a first end which is attached to the interior of the first storage compartment 2 and a second end that supports the retractable canopy 11 in the extended position. The retractable frame 10 is configured to extend outwardly supporting the retractable canopy 11 from the first storage compartment 2 a desired distance and then fold in upon itself when the retractable frame 10 and the retractable canopy 11 are retracted within the first storage compartment 2. The retractable frame 10 is configured to extend outwardly from the first storage compartment 2 to support the retractable canopy 11 so as to fully cover the passenger. A motor, and a roller, not shown, is housed within the first storage compartment 2 and is configured to roll or unroll and extend or retract the canopy 11 via the retractable frame 10.

FIG. 4 shows a rear view of the wheelchair accessory 1 attached to a wheelchair 13. The pair of lift arms 6 are shown extending out of third storage compartment 12 and pushing up the first storage compartment 2 and the second storage compartment 4 to an elevation above a rider's head. The second storage compartment 4 and the second flap 5 is opened and the telescoping neon-lighted flag pole 7 with the flag 8 at the end is in the extended position. The retractable canopy 11 is in the extended position. The unit attachment 21 is shown attaching the wheelchair accessory 1 to the back frame 22 of the wheelchair 13. A suitable power source 23 as shown schematically, is provided and is housed within the third compartment 12 for powering the retractable canopy 11, the telescoping neon-lighted flag pole 7, and the pair of lift arms 6 so as to be selectively extended and retracted in response to activation of either the first control pad 15 or the second control pad 16.

Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A wheelchair accessory for a wheelchair, said wheelchair accessory comprising:

a retractable canopy, said retractable canopy providing shelter from inclement weather for a passenger of said wheelchair, a telescoping neon-lighted flag pole, said telescoping neon-lighted flag pole providing visibility for said wheelchair to oncoming motorists, and a first control pad for attachment to an arm rest of said wheelchair, said first control pad configured to actuate said retractable canopy and said telescoping neon-lighted flag pole;

a first storage compartment having an interior for housing said retractable canopy, said first storage compartment having a first flap covering said first storage compartment when said retractable canopy is stored therein;

a second storage compartment attached rearwardly and laterally to said first storage compartment; said second storage compartment housing said telescoping neon-lighted flag pole, said second storage compartment having a second flap covering said second storage compartment when said telescoping neon-lighted flag pole is stored therein;

a third storage compartment, said third storage compartment comprising;

a second control pad operable to actuate said retractable canopy and said telescoping neon-lighted flag pole between an extended and contracted position;

a portable power source powering said retractable canopy and said telescoping neon-lighted flag pole so as to be selectively extended and retracted in response to activation of either said first control pad or said second control pad;

an attachment unit configured to secure said wheelchair accessory to said wheelchair;

a pair of apertures on an upper surface thereof; and a pair of lift arms housed therein and configured to selectively extend outwardly through said pair of apertures in response to activation of either said first control pad or said second control pad; wherein said lift arms have upper ends secured to a bottom of said first storage compartment such that said first storage compartment and said second storage compartment move in tandem with said lift arms.

2. The wheelchair accessory of claim 1 further comprising:

a retractable frame having a first end attached to said interior of said first storage compartment and a second end supporting said retractable canopy, wherein;

said retractable frame is configured to extend outwardly supporting said retractable canopy from said first storage compartment a desired distance and then fold in upon itself when said retractable frame and said retractable canopy are retracted within said first storage compartment.

3. The wheelchair accessory of claim 1 wherein:

said first and second control pads are configured to lower or raise said first compartment to a desired height, retract or extend said retractable canopy a desired distance outward, and lower or raise said neon-lighted flag pole a desired height for improving the visibility of said wheelchair to oncoming motorists.

4. The wheelchair accessory of claim 2 wherein said first control pad and said second control pad are operable to actuate said retractable canopy and said neon-lighted flag pole independently of one another.

* * * * *